US006318253B1

(12) United States Patent
Ohno

(10) Patent No.: US 6,318,253 B1
(45) Date of Patent: Nov. 20, 2001

(54) DOCUMENT FEEDER

(75) Inventor: Norihiro Ohno, Yamanashi-ken (JP)

(73) Assignee: Nisca Corporation, Yamanashi-ken (JP)

( * ) Notice: Subject to any disclaimer, the term of this patent is extended or adjusted under 35 U.S.C. 154(b) by 0 days.

(21) Appl. No.: 09/400,277

(22) Filed: Sep. 21, 1999

(51) Int. Cl.[7] ..... B41D 7/02
(52) U.S. Cl. ..... 101/33; 101/44
(58) Field of Search ..... 101/33, 44, 41, 101/35; 399/367, 374, 371; 400/624

(56) References Cited

U.S. PATENT DOCUMENTS 5,279,453 * 1/1994 Hashimoto ..... 399/367
5,497,250 * 3/1996 Kawashima ..... 358/498
5,515,153 * 5/1996 Tokunoh ..... 399/374
5,659,403 * 8/1997 Itoigawa ..... 358/474
5,784,680 * 7/1999 Taruki ..... 399/374
5,815,770 * 9/1998 Ogino ..... 399/410
5,819,152 * 10/1998 Kobayashi et al. ..... 399/367
5,921,545 * 7/1999 Kobayashi et al. ..... 271/242
5,999,646 * 12/1999 Tamagaki ..... 382/169

* cited by examiner

*Primary Examiner*—John S. Hilten
*Assistant Examiner*—Anthony H. Nguyen
(74) *Attorney, Agent, or Firm*—Kanesaka & Takeuchi

(57) ABSTRACT

A document feeder is formed of a transfer path for allowing a document to pass therethrough, a transferring device situated along the transfer path for transferring the document along the transfer path, a stamping device situated near the transfer path for impressing a mark on a surface of the document transferred by the transferring device, and a setting device connected to the stamping device for setting a density of the mark on the document impressed by the stamping device so that the mark impressed on the document becomes substantially constant in the density when it is used. A driving device is connected to the transfer device for controlling a transferring speed of the document by the transferring device in accordance with density information set by the setting device. Therefore, even if ink itself in the stamping device is consumed, impressed mark can be identified by a user by controlling the density of the impressed mark.

10 Claims, 7 Drawing Sheets

DOCUMENT FEEDER

BACKGROUND OF THE INVENTION AND RELATED ART STATEMENT

The present invention relates to a document feeder used in a combined machine having functions as a copier, printer, and facsimile, and more particularly, the present invention relates to a document feeder having a stamping device which impresses a document reading mark on a document.

There has been generally known a document feeder used in a combined machine having functions as a printer, facsimile or the like, wherein documents placed on a document table are sent sheet by sheet by paper supplying means, transferred by transferring means to pass through a reading section so that an image of the document is read by image reading means, and then ejected onto an ejection table. Among the document feeders, there is a document feeder attached with a stamping device for impressing a surface of the document with a mark for confirming whether reading the document is completed or not.

In the conventional document feeder provided with the stamping device, however, there has been a problem that when ink itself in the stamping device is consumed, impressing becomes lighter, so that a user can not confirm the mark easily.

Also, there has been a problem that impressing is not appropriately performed since ink is not adhered on the document or the ink is blurred depending on a kind of the document.

An object of the present invention is to provide a document feeder provided with a stamping device, wherein a density of an impressed mark is adjustable so that even if ink itself in the stamping device is consumed, a user can definitely identify the impressed mark.

SUMMARY OF THE INVENTION

To solve the above problem, the present invention provides a document feeder, which is formed of: transferring means for transferring a mark on a document along a transfer path; stamping means for impressing a surface of the document transferred by the transferring means; setting means for setting a density of impression by the stamping means; and driving means for controlling a transferring speed of the document by the transferring means in accordance with information of the set density by the setting means.

Also, the present invention provides a document feeder, which is formed of: a reading section for reading an image of a document; transferring means for transferring the document read by the reading section along a transfer path; stamping means for impressing a mark on a surface of the document transferred by the transferring means; document detecting means disposed in the transfer path; setting means for setting a density of impressing by the stamping means; and driving means for changing a transferring speed of the document from a first transferring speed to a second transferring speed according to a detected signal by the detecting means, and at the same time, for controlling the second transferring speed in accordance with information of the set density by the setting means.

DETAILED DESCRIPTION OF PREFERRED EMBODIMENTS

Hereinafter, details of the embodiments of the present invention will be explained with regard to the drawings.

Figure 1:
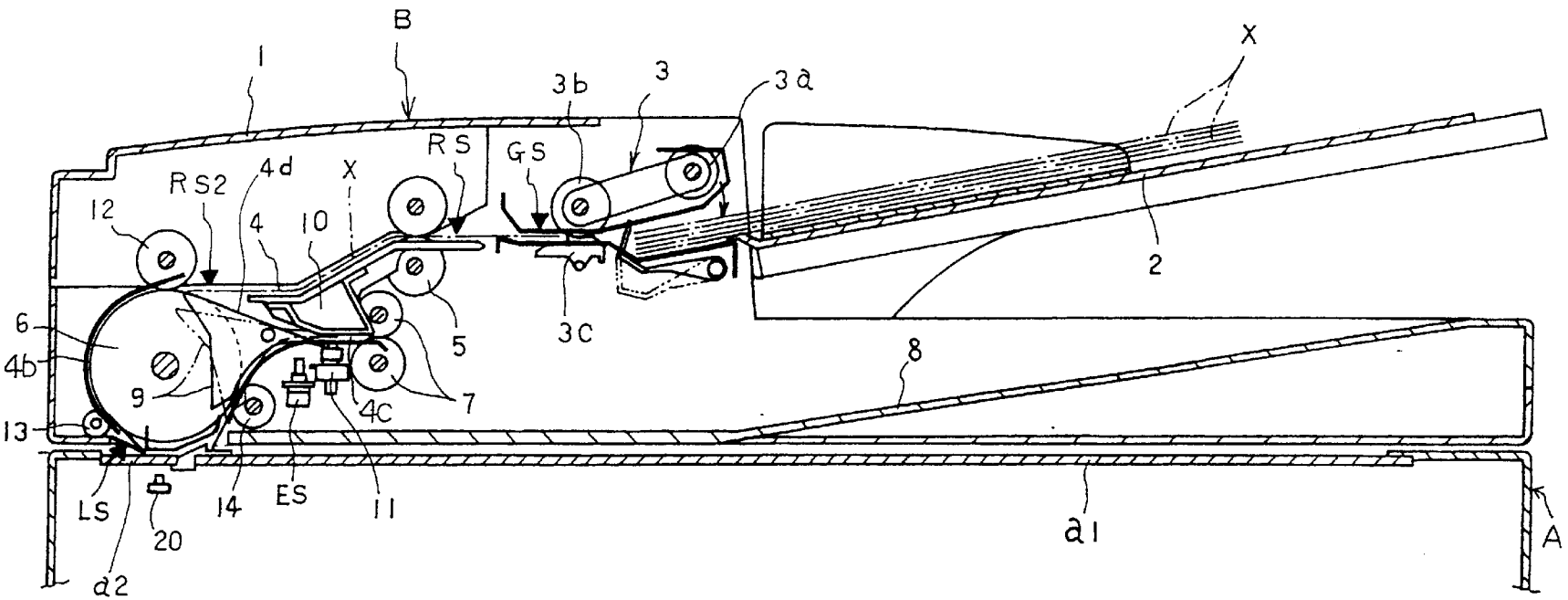
FIG. 1 is a sectional view of a document feeder according to the present invention.

FIG. 1 shows a structural part of a document feeder B disposed on an image forming apparatus A having multiple functions as, for example, a facsimile and a copier. The image forming apparatus A is provided with a platen al for reading a document such as a book; and a platen a2 disposed adjacent to the platen a1; and an image reading device 20 for being transferred to read the document disposed on the platen a1 and being stopped under the platen a2 to read the document transferred by the document feeder B.

An upper part of the document feeder B is provided with a document table 2 on which a plurality of documents can be placed in a stacked condition. The documents stacked on the document table 2 are sent by a feeding roller 3, and the documents are separated sheet by sheet by a supplying roller 3*b* and a separating member 3*c* pressed against the supplying roller 3*b* so as to be supplied to a downstream side.

In a middle of a document path 4, there are disposed a register sensor RS, which detects a leading edge of the document, and a pair of register rollers 5, and after the document is registered by the register rollers 5, the document is transferred to a feed roller 6 (transferring means) which faces the platen a2. By transferring the document on the platen a2 at a reading speed by the feed roller 6, an image of the document is read by the image reading means 20. At this time, start of reading the image of the document by the image reading means 20 is determined by a document detection by a read sensor LS disposed at an immediate front of the platen a2.

Next, the document which has passed through the platen a2 is transferred to switchback/ejection rollers 7, and ejected by the switchback/ejection rollers 7 onto an ejection tray 8 under the document table 2. However, in case the document is a double-sided document, the document is returned to the feed roller 6 through a circulation path 4*d* by reverse rotations of the switchback/ejection rollers 7, and a process of reading a back surface of the document is carried out. Between the feed roller 6 and the switchback/ejection rollers 7, there are disposed a switching flapper 9, which guides the document from a switchback/ejection path 4*c* to the circulation path 4*d*, and a reverse-ejecting sensor ES, which detects a leading edge and a rear edge of the ejected document.

Figure 2:
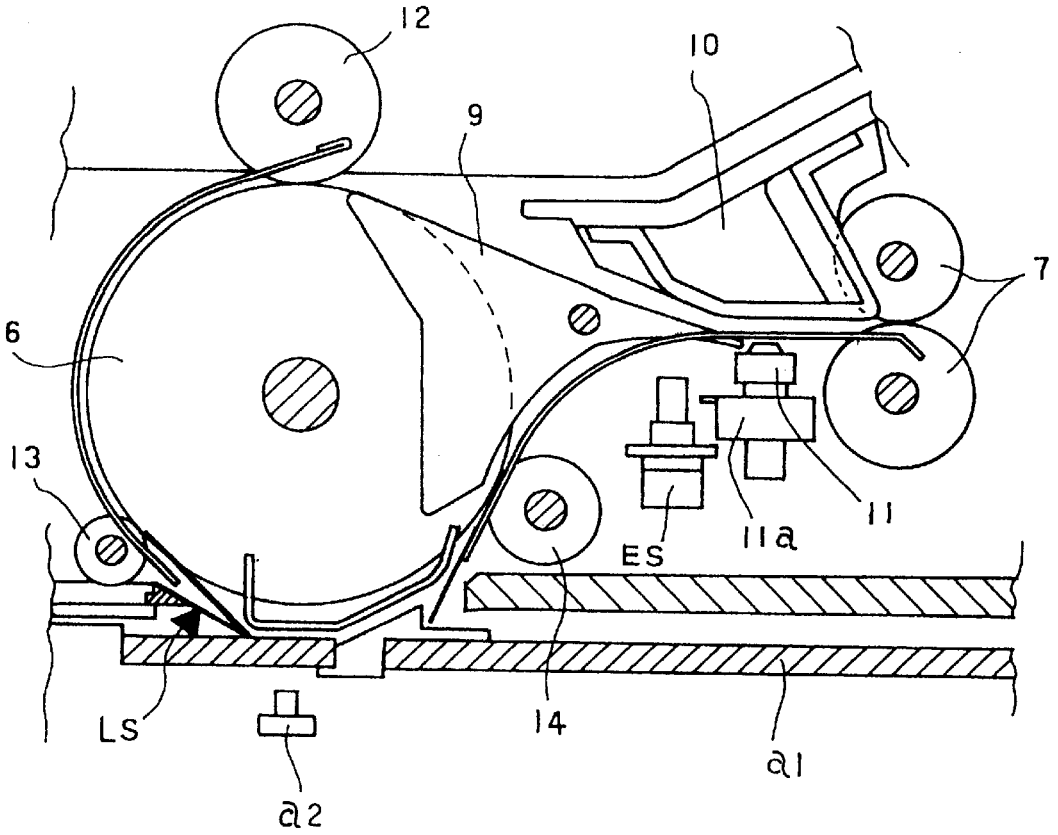
FIG. 2 is an enlarged sectional view of a main part of the document feeder.
Figure 3:
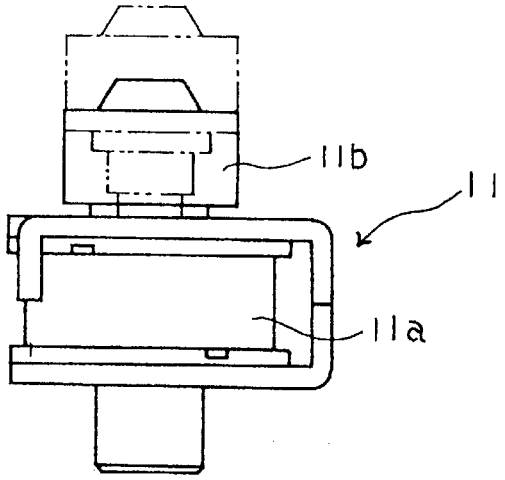
FIG. 3 is an enlarged side view of a stamping device to be used in the document feeder.

Furthermore, a stamp table 10 and a stamping device 11 are disposed in the switchback/ejection path 4*c*. As shown in detail in FIGS. 2 and 3, the stamping device 11 is structured that a solenoid 11*a* is excited to allow an impressing section 11*b* to project in the switchback/ejection path 4*c*, so that a mark is impressed at a predetermined position of the document.

Incidentally, symbols "12", "13", and "14" in FIG. 1 designate pinch rollers which are pressed against a peripheral surface of the feed roller 6.

Also, as driving sources for driving the respective rollers, a supplying motor KM and a transferring motor HM are provided. The supplying motor KM has a driving system such that the supplying motor KM rotates forward to drive the feeding roller 3*a* and the supplying roller 3*b*, and the supplying motor KM rotates reversely to drive the register rollers 5. Also, the transferring motor HM drives the feed roller 6 and the switchback/ejection rollers 7.

Figure 4:
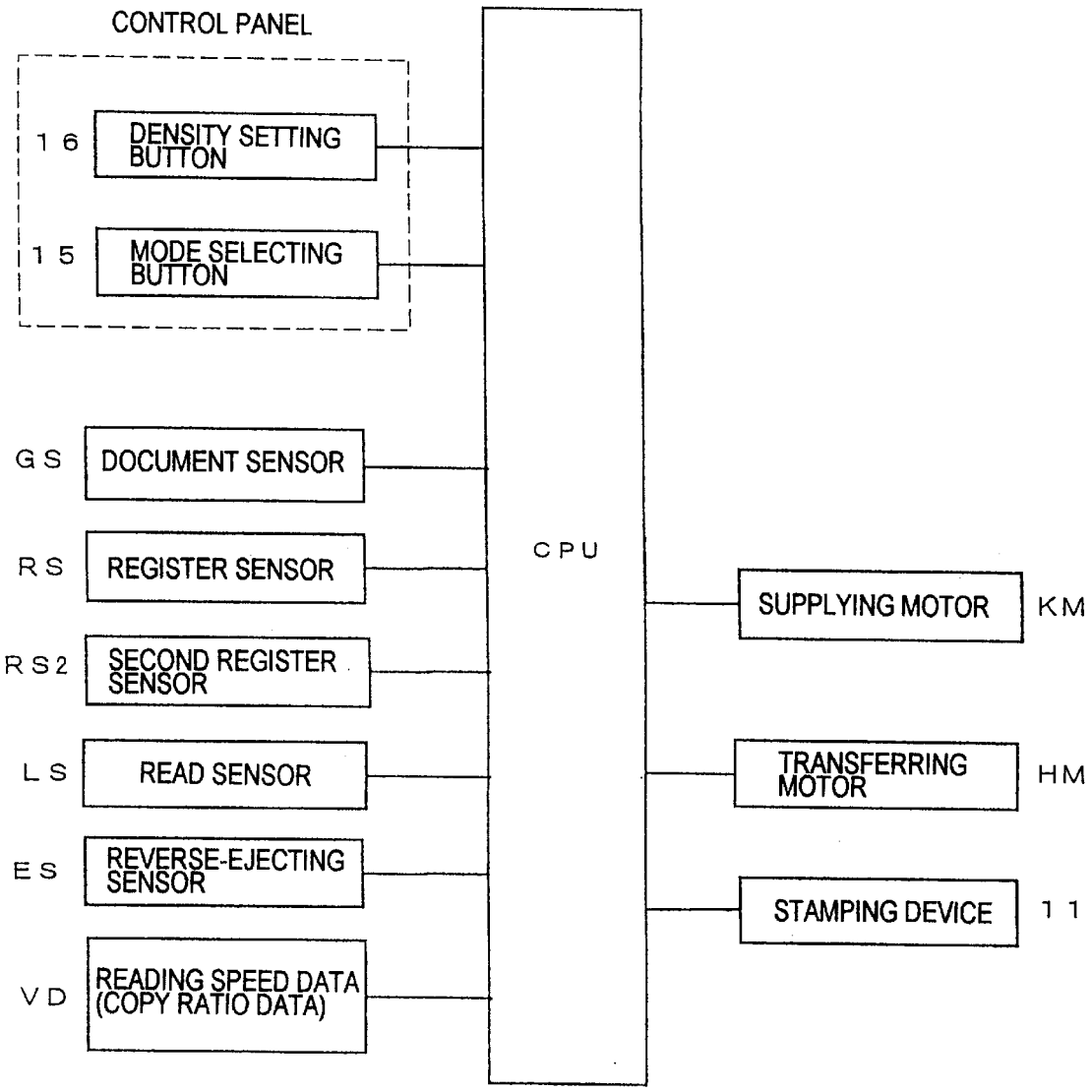
FIG. 4 is a block diagram of a control section of the document feeder.

FIG. 4 is a block diagram of a control section of the document feeder B according to the present invention, and into a control device CPU, which can be formed of, for example, a micro computer, there are inputted a designated mode signal from a mode selecting button 15; a stamp density signal from a density setting button; detected signals from a document sensor GS, a register sensor RS, a second register sensor RS2, and the read sensor LS; a document detected signal from the reverse-ejecting sensor ES; and reading speed data VD from the image forming apparatus A. The control device CPU controls the supplying motor KM and the transferring motor HM, which are normally rotated at a reading speed, in accordance with respective process flows and stamp density signals of a non-stamp mode, a stamp mode, an one-side stamp mode, and a two-side stamp mode, which are selected by the mode selecting button 15. Also, the control device CPU issues an operation instruction to the solenoid 11*a* of the stamping device 11 at proper timing according to the selected non-stamp mode and the stamp mode (one-side stamp mode and two-side stamp mode) so as to actuate the stamping device 11 in accordance with the stamp density signal.

Figure 5:
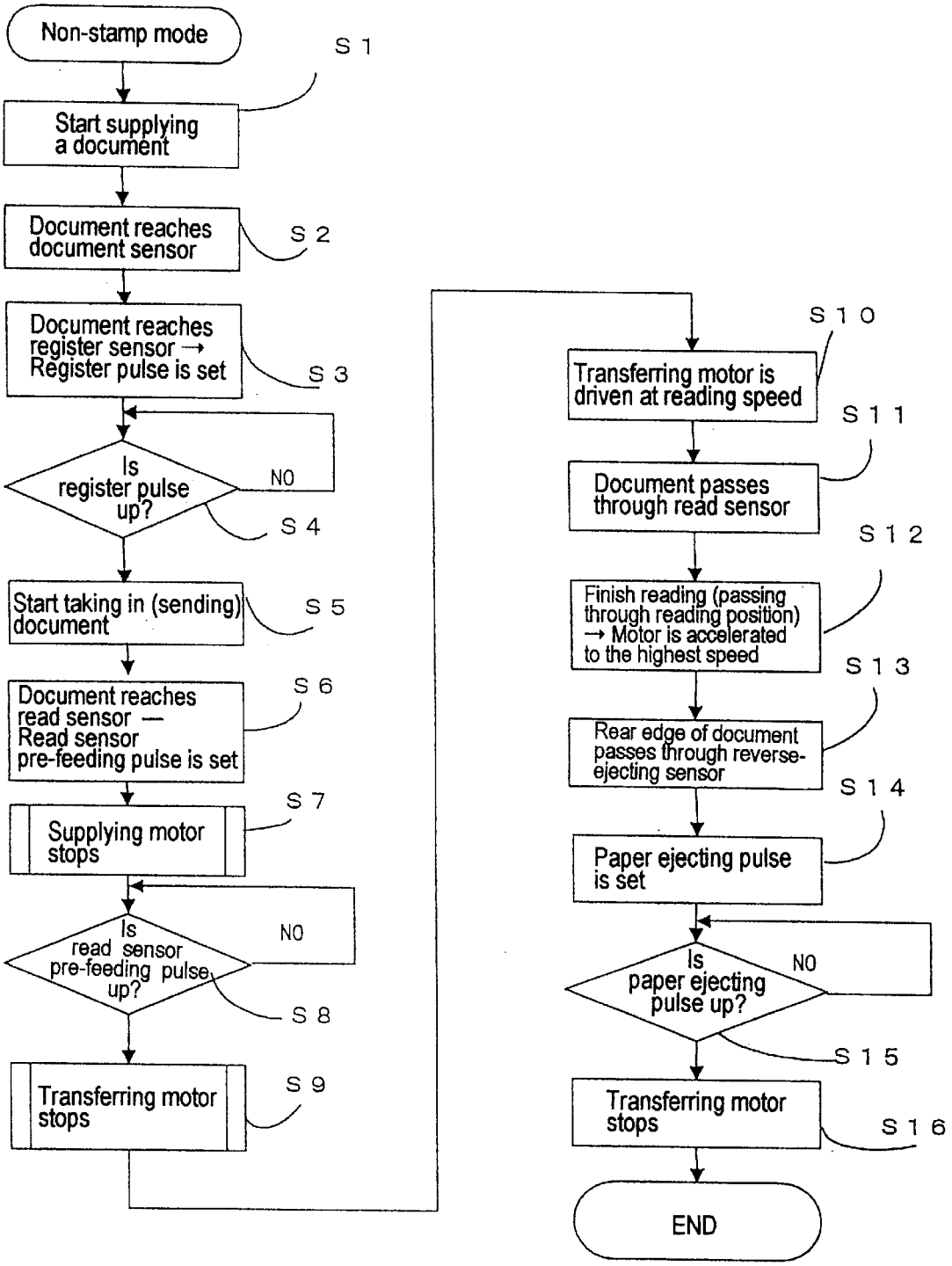
FIG. 5 is a chart showing a control flow of the document feeder in a non-stamp mode.

Next, operations of the document feeder B according to the embodiment shown in the figures will be explained in detail with regard to FIGS. 5 and 6. FIG. 5 shows a control flow at the non-stamp mode, and when a leading edge of the document sent out from the document table is detected at the register sensor RS, a register pulse in a predetermined period of time is set, so that the document is sent out by the supplying roller 3*b* until the register pulse is counted up. The sent document abuts against the register rollers 5 to be aligned (step S1 to step S4).

In step S5, the document is sent toward the feed roller 6 by rotation of the register roller 5. When the leading edge of the document is detected by the read sensor LS (step 6), the document is securely nipped by the feed roller 6 and the pinch roller 13. Thus, the supplying motor KM is stopped in step S7, and after a predetermined pulse is counted up (step S8), the transferring motor HM is stopped (step S9). Accordingly, the document is stopped before the reading position, and thereafter, the document stopped before the reading position is transferred again based on a reading timing signal from the image forming apparatus A at the reading speed so as to pass through the reading position on the platen a2 (step S10). While the document passes through the reading position on the platen a2, the image of the document is read by the image reading means 20.

With transfer of the document on the platen a2 for a predetermined length after a rear edge of the document is detected by the read sensor LS (step S11), it is recognized that reading the image of the document is completed, so that the transferring motor HM is switched to the highest speed to eject and transfer the document at a high speed in order to reduce time from supplying the document to ejecting the same (step S12). Thereafter, when the rear edge of the document ejected and transferred at the high speed is detected by the reverse-ejecting sensor ES (step S13), paper ejecting pulse is set (step S14). When the paper ejecting pulse is counted up (step S15), it is determined that the document is ejected onto the paper ejecting tray, so that the transferring motor HM is stopped (step S16).

Naturally, in case there are subsequent documents on the document table 2, the flow returns to the start, and transferring process and reading process are carried out continuously until the processes for all documents are completed.

Figure 6:
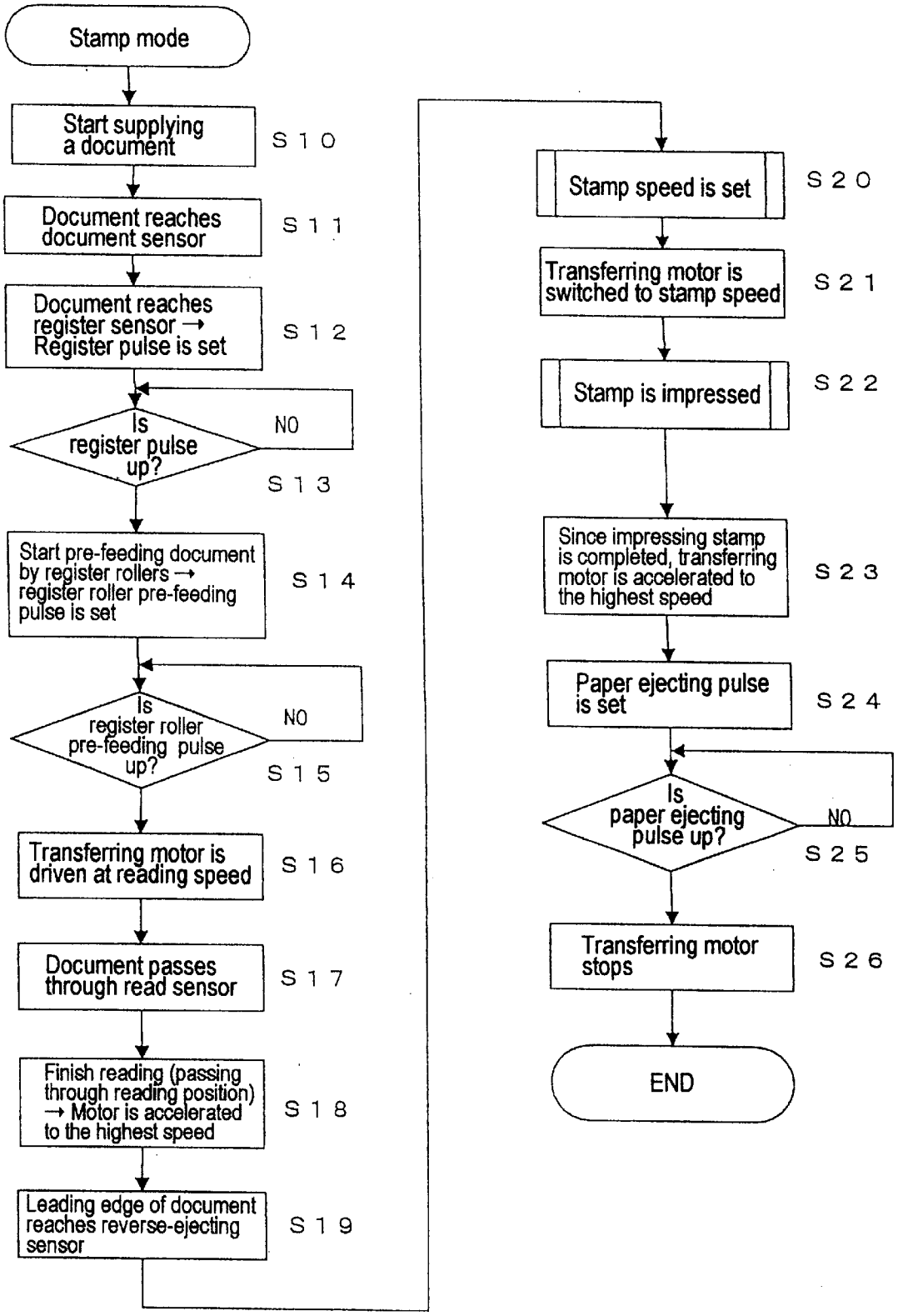
FIG. 6 is a chart showing a control flow of the document feeder in a stamp mode.

Next, the control flow in the stamp mode is shown in FIG. 6.

In step S10 to step S16 in the stamp mode, processes similar to the steps S1 to S7 in the non-stamp mode as described above are carried out.

Then, when reading the document image of the document is completed in step S17, the transferring motor HM is driven at the highest speed in step S18, and the document, image reading of which has been completed, is ejected and transferred at a high speed toward the switchback/ejection rollers 7.

When the rear edge of the document is detected by the reverse-ejecting sensor ES (step S19), in step S20, an ejecting and transferring speed of the document (a stamp speed) is determined by a density signal sent based on density information set by the density setting button 16 in a control panel P. Then, the transferring motor HM controls the rotational speed of the switchback/ejection rollers 7 such that the document is ejected and transferred at the determined speed (step S21).

The stamping device 11 is actuated to impress a mark on one surface of the document transferred at the stamp speed switched by this series of the operations (step S22).

In operations of the stamping device 11, excitation time or impressing duration for the solenoid 11*a* of the stamping device 11 is such that the solenoid is excited for a period of time selected by the signal sent based on density information set by the density setting button 16 in the control panel, so that the impressing section 11*b* of the stamping device 11 is protruded in the switchback/transfer path 4*c* to impress the mark on the document.

Figure 7:
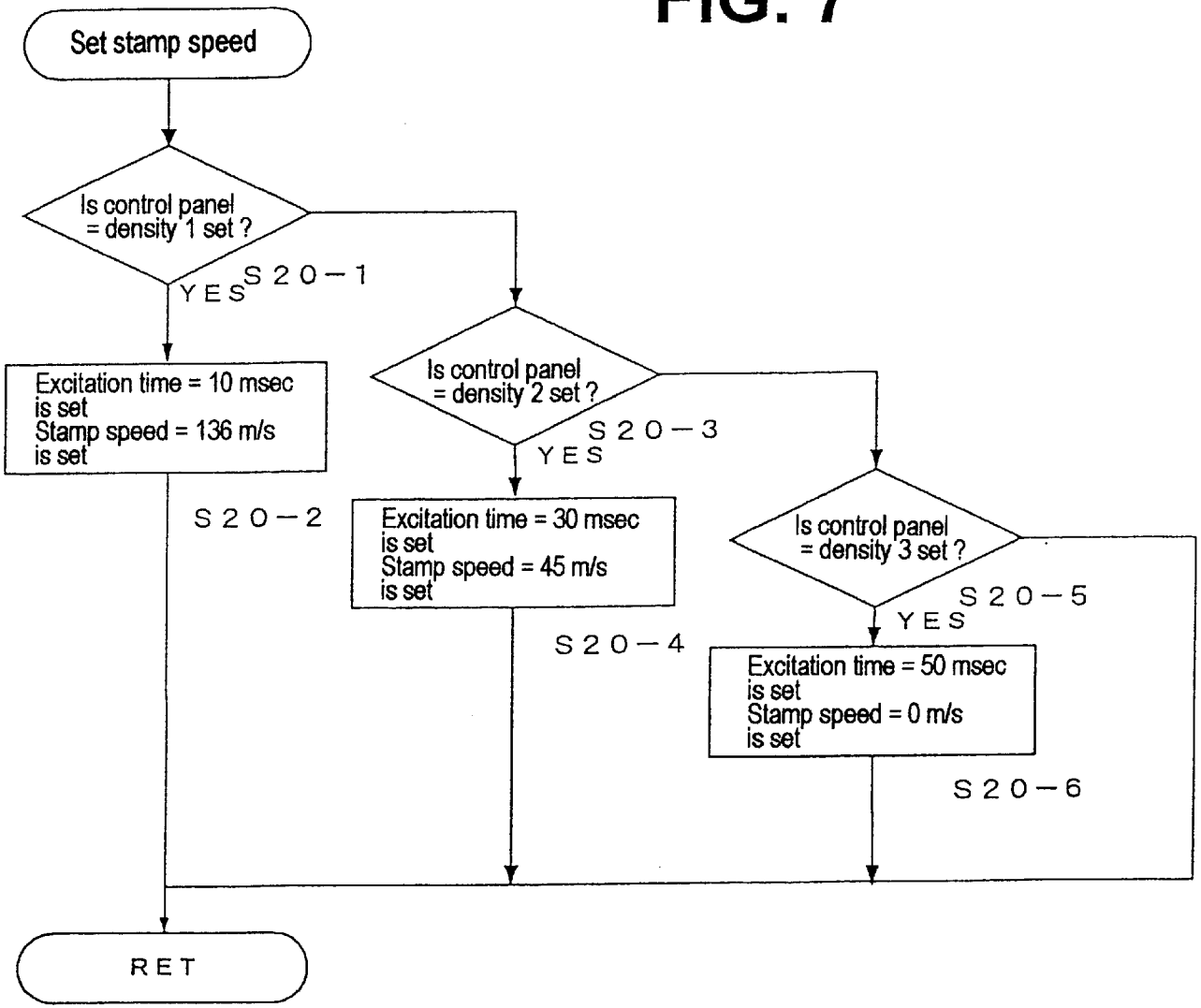
FIG. 7 is a chart showing a stamp speed setting control flow of the document feeder in a stamp mode.

Incidentally, the density setting button 16 on the control panel is divided into three steps, and as shown in FIG. 7, it sets the excitation time for the solenoid 11*a* and the stamp speed. In case a signal sent from the control panel P is density 1, excitation time of 10 msec. and a stamp speed at 136 m/s are set (steps S20-1 and S20-2). In case of density 2, excitation time of 30 msec. and a stamp speed at 45 m/s are set (steps S20-3 and S20-4); and in case of density 3, excitation time of 50 msec. and a stamp speed at 0 m/s are set (stop).

By changing the excitation time and the stamp speed as described above, impressing time by the stamping device with respect to the stamp position of the surface of the document can be extended or shortened, so that the density of the mark in the document can be freely adjusted. Namely, if ink of the stamping device is consumed such that the mark impressed on the document becomes lighter, the user can operate the density setting button 16 in the control panel P to extend the impressing time by the stamping device with respect to the stamping position of the surface of the document, resulting in that the impressed mark can be adjusted at a satisfactory density.

Also, if the impressing time by the stamping device is extended and the ejecting and transferring speed of the document is reduced, rubbing mark caused by extending the time for impressing the document can be prevented. When the impressing time by the stamping device is shortened and the ejecting and transferring speed of the document is accelerated, time for exchanging the document in the stamp mode can be reduced.

After the stamping device 11 impresses the mark on the surface of the document, the ejecting and transferring speed is again switched to the high speed by the transferring motor HM (step S23), and thereafter, the rear edge of the document ejected and transferred at the high speed is detected by the reverse-ejecting sensor ES, so that the paper ejecting pulse is set (step S24). When the paper ejecting pulse is counted up (step S25), it is determined that the document is ejected onto the ejecting tray, so that the transferring motor HM is stopped (step S26).

Incidentally, in the present embodiment, when the rear edge of the document is detected by the reverse-ejecting sensor ES, the transferring motor HM is switched to the stamp speed so that the stamping device 11 impresses the mark on the surface of the document. However, when a predetermined period of time has passed after the leading edge of the document is detected, the ejecting and transferring speed may be switched to the stamp speed by controlling the transferring motor HM, so that the stamping device 11 impresses the mark on the surface of the document.

Also, the document feeder B of the embodiment shown in the figures can perform the image reading process of the double-sided document, and in case of the double-sided document, a one-side stamp mode or two-side stamp mode can be selected by the mode selecting button 15.

Firstly, in the one-side stamp mode, after the front surface of the document is read, when the rear edge of the document is detected by the reverse-ejecting sensor ES, the switching flapper 9 is switched by the signal from the reverse-ejecting sensor ES, and at the same time, the switchback/ejection rollers 7 are reversely rotated. Thus, the document, reading of the front surface of which has been completed, is returned to the platen a2 by the feed roller 6 in the condition that the back surface of the document faces down, and the back surface of the document is read by the image reading means 20. The document, reading of the back surface of which has been completed, is returned to the feed roller 6 by the detected signal of the reverse-ejecting sensor ES again. However, at this time, reading the document is not performed, and in the condition that the front surface of the document faces down, the stamping device 11 impresses the mark on the front surface of the document, and then the document is ejected onto the ejection tray 8 by the switchback/ejection rollers 7.

In case of the two-side stamp mode, after the front surface of the document is read, the rear edge of the document is detected by the reverse-ejecting sensor ES, so that the stamping document 11 is actuated to impress the mark at a portion near a rear edge portion of the front surface of the document. Then, the switching flapper 9 is switched by the signal from the reverse-ejecting sensor ES, and at the same time, the switchback/ejection rollers 7 are rotated reversely. Therefore, the document, reading of the front surface of which has been completed, is returned to the platen a2 by the feed roller 6 in the condition that the back surface of the document faces down, and the back surface of the document is read by the image reading means 20. With respect to a portion near a rear edge portion of the back surface of the document, reading of the back surface of which has been completed, a stamp process is carried out while the document passes through the stamping device 11, and the document is ejected onto the ejection tray 8 by the switchback/ejection rollers 7.

Although the stamp speed and the exciting time for the excitation solenoid by the stamping device can be freely switched on the panel by the user in the aforementioned embodiment, they may be switched in accordance with a number of impressing times by the stamping device.

Figure 8:
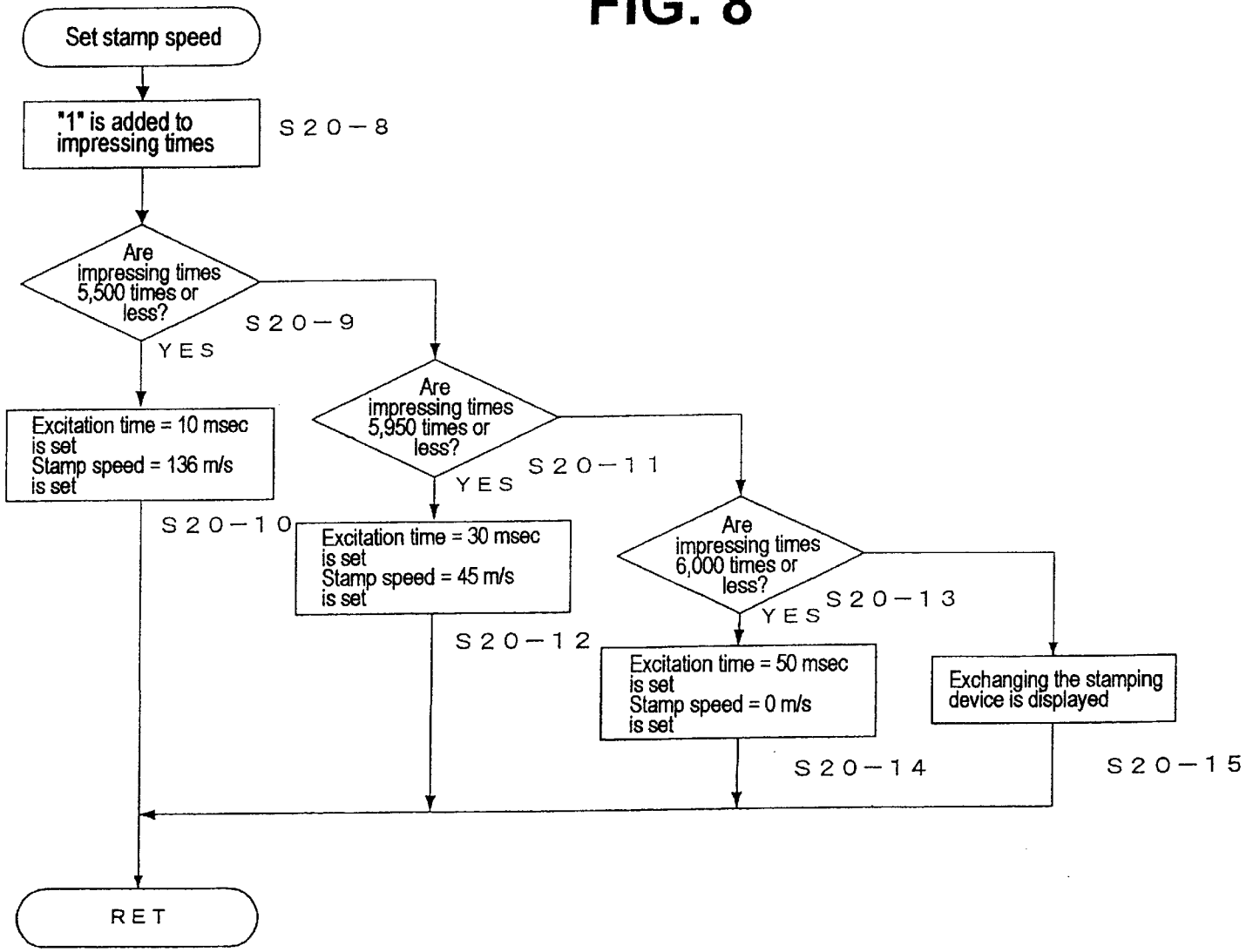
FIG. 8 is a chart showing a stamp speed setting control flow of another embodiment of the document feeder in a stamp mode.

In this case, one is added to an impressing counter after impressing the mark on the document is completed, and when reaching the predetermined number of times, the stamp speed and exciting time for the excitation solenoid by the stamping device can be automatically switched. Namely, as shown in FIG. 8, in case impressing times are 5,500 times or less according to a counted value by a stamp counter, excitation time is set at 10 msec. and the stamp speed is set at 136 m/s (step S20-9, step S20-10); in case the impressing times are 5,501 times to 5,950 times, the excitation time is set at 30 msec. and stamp speed is set at 45 m/s live (step S20-11, S20-12); and in case the impressing times are 5,950 times to 6,000 times, the excitation time is set at 50 msec., and the stamp speed is set at 0 m/s (stop). Also, in case of over 6,000 times, exchanging the stamping device is displayed (step S20-15).

Also, although exciting time for the excitation solenoid by the stamping device is switched in the aforementioned embodiment, the exciting time for the excitation solenoid by the stamping device may be uniform, and pressing force with respect to the document by the stamping device may be switched. The pressing force by the stamping device can be changed by controlling excitation current value of the solenoid, and in this case, it can be set such that:

in case of the density 1, the excitation current is 0.25 Å and the stamp speed is 136 m/s:

in case of the density 2, the excitation current is 0.35 Å and the stamp speed is 45 m/s: and case of the density 3, the excitation current is 0.50 Å and the stamp speed is 0 m/s.

According to the present embodiment, the set time for impressing the mark on the document or pressing force by the stamping device is switched, and at the same time, the ejecting and transferring speed of the document at the time of operating the stamping device is switched. Therefore, the density of a mark impressed on the document can be adjusted.

What is claimed is:

1. A document feeder, comprising:

a transfer path for allowing a document to pass therethrough, transferring means situated along the transfer path for transferring the document along the transfer path, stamping means situated near the transfer path for impressing a mark on a surface of the document transferred by the transferring means, setting means connected to the stamping means for setting a density of the mark on the document impressed by the stamping means so that the mark impressed on the document becomes substantially constant in the density when it is used, said setting means including at least one of a setting panel for setting a desired density of the mark on the document, and counter means for counting a number of usage of the stamping means, said setting panel setting in advance at least one of an impressing force and an impressing duration of the stamping means relative to the document, said counter means automatically setting at least one of the impressing force and the impressing duration of the stamping means relative to the document based on the number of usage of the stamping means, and driving means connected to the transfer means for controlling a transferring speed of the document by the transferring means in accordance with density information set by the setting means.

2. A document feeder according to claim 1, further comprising controlling means connected to the setting means and the stamping means for controlling time for impressing the mark on the surface of the document by the stamping means in accordance with the density information set by the setting means.

3. A document feeder according to claim 1, wherein as the impressing duration to the document is increased, a transfer speed of the document at the stamping means by the driving means is reduced.

4. A document feeder according to claim 1, wherein said setting means includes operating means capable of inputting the density information.

5. A document feeder according to claim 1, wherein said setting means includes counting means for counting a number of impression of the documents by the stamping means so that the stamping means is controlled to provide the mark with substantially constant density on the document regardless of the number of the impression.

6. A document feeder, comprising:

a transfer path for allowing a document to pass therethrough, a reading section situated near the transfer path for reading an image of the document, transferring means situated along the transfer path for transferring the document read by the reading section along the transfer path, stamping means situated near the transfer path for impressing a mark on a surface of the document transferred by the transferring means, document detecting means provided in the transfer path, setting means connected to the stamping means for setting a density of the mark on the document impressed by the stamping means so that the mark impressed on the document becomes substantially constant when it is used, said setting means including at least one of a setting panel for setting a desired density of the mark on the document, and counter means for counting a number of usage of the stamping means, said setting panel setting in advance at least one of an impressing force and an impressing duration of the stamping means relative to the document, said counter means automatically setting at least one of the impressing force and the impressing duration of the stamping means relative to the document based on the number of usage of the stamping means, and driving means connected to the transferring means for changing a transferring speed of the document from a first transferring speed to a second transferring speed by a detected signal of the document detecting means, said driving means controlling the second transferring speed in accordance with density information by the setting means.

7. A document feeder according to claim 6, wherein the driving means changes the transferring speed of the document from the first transferring speed to the second transferring speed according to a document leading edge detection signal by the document detecting means.

8. A document feeder according to claim 6, wherein the driving means changes the transferring speed of the document from the first transferring speed to the second transferring speed according to a document rear edge detection signal by the document detecting means.

9. A document feeder according to claim 6, wherein the driving means controls the transferring speed of the document such that the document transferring speed is returned to the first transferring speed again after the transferring speed of the document is changed from the first transferring speed to the second transferring speed according to a detected signal by the document detecting means.

10. A document feeder according to claim 6, wherein as the impressing duration to the document is increased, a transfer speed of the document at the stamping means by the driving means is reduced.

* * * * *